US005356084A

United States Patent [19]

Gamblin

[11] Patent Number: 5,356,084

[45] Date of Patent: Oct. 18, 1994

[54] IMPROVED FEED FOR CENTRIFUGAL MILLS

[76] Inventor: Rodger L. Gamblin, 8 Springhouse Rd., Dayton, Ohio 45409

[21] Appl. No.: 55,745

[22] Filed: May 3, 1993

[51] Int. Cl.[5] ..... B02C 17/08

[52] U.S. Cl. ..... 241/171; 241/137

[58] Field of Search ..... 241/137, 171, 172, 175, 241/153

[56] References Cited

U.S. PATENT DOCUMENTS 2,069,164 11/1937 Vogel-Jorgensen ..... 241/172 X
5,029,760 7/1991 Gamblin ..... 241/65
5,205,499 4/1993 Gamblin ..... 241/137

*Primary Examiner*—Douglas D. Watts

[57] ABSTRACT

A mill for comminution comprising a cylinder rotating with its axis perpendicular to a uniform inertial force field that has helical chambers at each end of the cylinder that are coaxial to and connected with the cylinder. The other end of each helix is connected to an external connection such that one feeds into and the other removes material from the mill. The helical chambers have opposite senses of rotation so that when the mill is rotated in one of its two possible directions any media in the mill is dynamically retained in the mill by the screw action of the helices even as material to be ground flows through the mill.

8 Claims, 3 Drawing Sheets

IMPROVED FEED FOR CENTRIFUGAL MILLS

RELATED PREVIOUS INVENTIONS

In U.S. Pat. No. 5,029,760 issued Jul. 3, 1991, U.S. Pat. No. 5,205,499, issued Apr. 27 1993, and in a U.S. patent application of even dale herewith entitled "Improved Planetary Grinding Apparatus", I describe various configurations of planetary grinding systems that have the capability of being continuously fed without the use of rotating seals. This invention is an improvement upon such devices and upon ball mills.

BACKGROUND OF THE INVENTION

1. Field of the Invention

This invention relates to the field of grinding or comminution and dispersion and more particularly to the reduction of solid matter into fine particles.

The reduction of solid matter into fine powders is a major task of an industrial society. As an example Portland cement is made from finely ground limestone, clay or shale, sand, and coal or other fuel. The limestone, clay or shale, and sand are subjected to a thermal process in which the heat is derived from the coal and the results are clinkers of material that must again be ground to produce the cement. Gypsum, after calcining, must be ground to produce sheet rock and other such products.

The food industry grinds many products including wheat, corn, rice, spices, sugar, and even chocolate. Paints, inks, and so forth use ground pigments and in turn undergo a dispersion process to disperse the ground pigment in a suitable vehicle.

Ceramics are made from finely ground materials. Generally the better the grind the better the ceramic product. Metals are ground as part of powder metallurgy and to prepare metallic pigments.

2. Description of the Prior Art

One of the oldest and simplest methods of grinding materials to fine powders uses a ball mill that generally consists of a horizontal cylindrical chamber that may be of any size. Ball mills have been constructed in sizes of up to eighteen feet in diameter by fifty or sixty feet long.

For many applications the ball mill is about half full of steel or ceramic balls in addition to the material to be ground. The balls roll over one another and aid in the grinding process.

In cases where the material to be ground, such as a paint, consists of a fine pigment to be dispersed, the balls, usually called the grinding media, are essential to the process while in other cases such as the grinding of cement clinker, the media is omitted. In this latter case the larger clinkers act as media for the smaller ones and a means is usually provided for extracting only the finer particles from the mill.

While the ball mill is effective and reliable, it tends to be large and slow. The physical size of the mill tends to cause it to be high in capital cost for the amount of work done.

There is much art having to do with overcoming the deficiencies of the ball mill. Alternative approaches to the task of grinding include mills wherein a material is stirred with media by means of mandrels. In another approach the material being ground in a liquid carrier is subjected to high shear rates by high speed blades or by being forced through narrow gaps between rapidly moving surfaces. These devices are most useful for dispersion while a ball mill both grinds and disperses.

In yet other attempts to obtain the benefits of a ball mill while overcoming its deficiencies, considerable prior art has addressed planetary mills in which the grinding chamber is orbited about an axis parallel to the axis of the grinding chamber. In such art the planetary motion imparts a centrifugal force that aids the action in the grinding chamber.

In U.S. Pat. No. 5,029,760 I describe a system wherein a rotatable drum assembly carries two rotatably mounted grinding tubes that are constrained to have no net rotation with respect to the base of the machine. Access to the grinding tubes may be made only to their ends and only one of the two grinding tubes may be addressed from either end. A second embodiment uses a series of four rotating wheels that drive two oppositely mounted frames that each carry one or more grinding tubes.

In U.S. Pat. No. 5,205,499 I describe a rotatable drum assembly that carries a single grinding tube that has advantages of permitting access to the grinding tube from both ends.

In a separate application of even date herewith entitled, "Improved Planetary Grinding Apparatus", I have described an improvement to the systems described in both of these previous patents wherein the improvement permits more ready access to the grinding tubes so that continuous feeding of the device is easier and more flexible than with previous methods.

Ball mills and planetary mills have in common that both use cylindrical grinding chambers that rotate in a force field that is perpendicular or almost perpendicular to the axis of rotation. This force field, in the case of a ball mill, is the gravitational field of the earth and, in the case of a planetary mill, is the centrifugal field generated by the planetary motion. Because of the equivalence of forces due to acceleration and gravitation, it can reasonably be said that ball mills and planetary mills both operate due to inertial fields.

It is advantageous to operate both ball and planetary mills in a continuous manner, with continuous feed being especially important for planetary devices. With ball mills the volume of the mill tends to be quite large, and the time required for grinding long. In a batch mode, that is, where the device is filled, run and then emptied, then refilled and so forth, ball mills might be loaded once a day and allowed to grind for twenty four hours. Though the time required for grinding is long, since the mill is large, significant production takes place and loading and unloading the mill is not an undue burden.

Still, even in the case of ball mills, it may be convenient to operate the mill continuously and to feed and withdraw material as steady streams. In such a case the mill needs almost no attention and production takes place with minimal labor content.

With a planetary mill, however, the volume of the mill tends to be small and the time for grinding only a few moments. If continuous feed is not used, much of the operating cycle may be spent in starting and stopping and loading and unloading the mill. In the case of a planetary mill it is usually a practical necessity that the device be continuously fed.

As has been discussed at length in my previous patents, listed above, it is possible to construct planetary mills that achieve continuous feed and withdrawal of the material being ground without rotating seals. Ball mills, on the other hand, appear to require such seals. Fortunately ball mills rotate at a relatively slow rate so that rotating seals are not much of a problem with continuous feed systems for such mills.

Two major problems exist with continuous feed systems. The first is that since the mill is usually a single cylinder, material that is insufficiently ground may bypass grinding in the mill and be found in the output so as to compromise the grind. This problem can be overcome by making the mill long compared to its diameter, or by dividing the mill into separate connecting chambers so that equilibration tends to take place in stages (such an arrangement is sometimes called a tube mill).

The second problem has to do with the separation of media used for grinding in the mill from the material being ground. Especially in the case of planetary mills, wherein the grinding tube may be quite small in volume compared to the volume of the material going through the mill per unit time, there is a tendency for media to be carried along with the ground material. Since any media retained with the ground material tends to be a major problem, precautions need be taken to prevent media from being mixed with the product from the mill.

This problem has become especially severe in recent times because demand for ever finer grinds has led to the use of ever finer media in milling machines in general. This invention addresses this particular problem by providing for helical chambers at each end of a mill that tend to screw media back toward the center of the mill while permitting free flow of the material being ground.

SUMMARY OF THE INVENTION

In the present invention I describe an improvement to ball mills or planetary mills, mills such as the ones I have described in the inventions listed above, that gives a powerful, dynamic separation of the media used in the mill from the material being ground.

Each grinding tube in the mill has a longitudinal section at each end of its length that has a helical chamber that wraps helically around or within and coaxial with the grinding tube. If a helical chamber at one end has a right hand orientation, the helical chamber at the other end is left handed. When the mill is rotating in the appropriate direction, the media is constantly driven toward the center of the grinding tube by the screw action of the helical chambers.

Input and output connections to the mill are made at the ends of the helical chambers most remote from the center of the grinding tube. Material entering the mill can readily be pumped through the helical chamber to the center of the mill where it is ground, but the media, which has a different specific gravity than the material to be ground, is driven to the outer wall of the helical chamber by the force field inherent with ball and planetary mills. At the wall of the helix the media is moved by the relative rotation of the helix axially toward the center of the grinding tube.

It is not obvious, but it is true that the specific gravity of the media need only be different from that of the material being ground, that is, the media may have either a greater or lesser specific gravity than the material being ground. In either case the media will be driven toward the longitudinal center of the mill as it operates. If the media and material have the same specific gravity, then, as with most media mills, no grinding takes place, and in the case of the instant invention no separation of the media from the material being ground takes place.

In the case of planetary mills, the centrifugal forces in the mill enhance the forces that cause separation of the media from the material being ground so that especially clean separations take place even in difficult situations. The forces that operate in planetary mills are described in more detail (and more quantitatively) below.

DETAILED DESCRIPTION OF THE INVENTION

In the case of a ball mill, it has long been known that grinding of material into a fine powder and homogeneous dispersion of fine powder can be obtained if the mill is operated for a sufficiently long time, e.g. 24 hours. Grinding results from the cascading of the balls against each other, the wall of the mill, and the material to be ground. Cascading of the balls results from the fact that the rotation of the cylindrical grinding chamber and the viscosity of the material to be ground tends to carry the balls up the walls of the grinding chamber until the force of gravity cause the balls and the material to be ground to flow. At high rotational speeds, the centrifugal forces developed overcome the gravitational forces developed and neither cascading nor grinding occurs. The grinding power of a ball mill, which determines its capacity, is directly related to its size.

However, if the grinding chamber is orbited about an axis parallel to its own axis and rotated about its own axis in the opposite direction at a rate of one rotation per orbit, the grinding chamber will maintain a fixed orientation with respect to the machine base.

Figure 1:
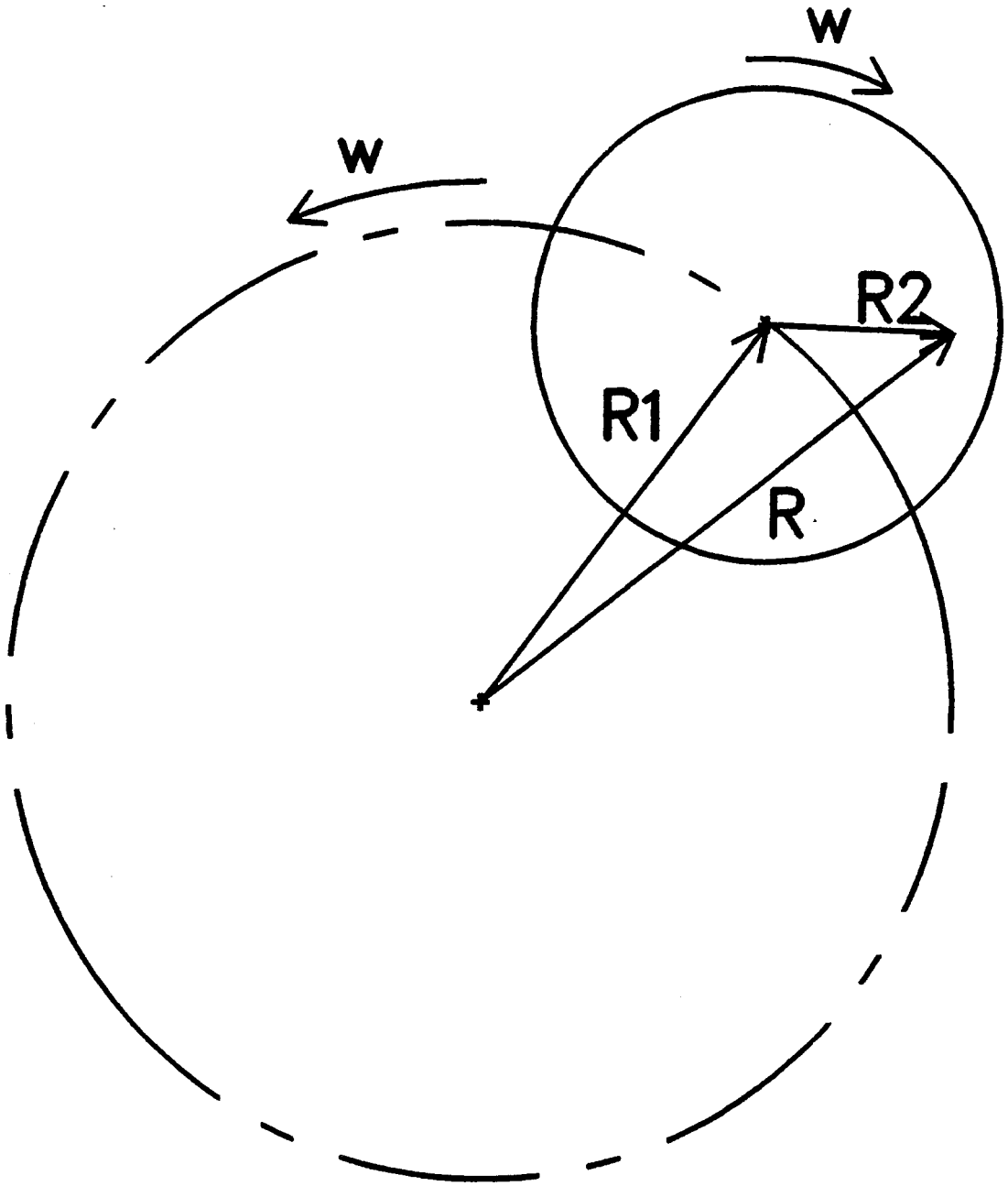
FIG. 1 is a diagram of the vectors that determine the location through time of an element of material moving with the grinding tube of a planetary mill.

The analysis of such a mill starts by defining three vectors which are diagramed in FIG. 1. The first is from the center of rotation of the planetary motion to the center of the grinding tube and is called R1. The second vector is any vector from the center of the grinding tube to any point on the grinding tube. This vector is R2. The third vector is the sum of R1 and R2 and thus is a vector from the center of the planetary motion to any point on the grinding tube. Symbolically R is given by $R=R1+R2$.

Let the second derivative of R with respect to time be taken when the mill is in operation. As observed above the grinding tube always maintains its orientation in space so that R2 does not vary with time. Both its first and second derivatives are thus zero, and the second derivative of R is the same as the second derivative of R1, which, in turn, is a vector of magnitude $w^2$ R1 pointed toward the origin, where w is the rotational speed in radians per second. What all this means is that an element of material carried by the grinding tube and rotating with this tube experiences forces exactly as if it were in a gravitational field of magnitude $w^2R1$.

In the case of a ball mill it has been observed that the best grinding action takes place when the media in the mill is at about a 45 degree angle. This angle is observed when the ratio of force due to centrifugal force is about $\frac{1}{2}$.15 that due to gravity. In the case of the planetary mill, the force that is comparable to gravity is given as $w^2R1$ while that comparable to the centrifugal force is given by $w^2R2$. In the case of a planetary machine, again the ratio of the centrifugal force to the equivalent of the gravitational force must be taken as $\frac{1}{2}.15$ in order to maintain a 45 degree grinding angle. When this ratio is taken, however, the speed of rotation drops out, and it can be seen that the condition for the 45 degree grinding angle is just that R1 and R2 be in the ratio of $\frac{1}{2}.15$.

The fact that the rotation speed drops out means that the media angle in the mill is independent of rotation speed. Such a result is certainly desirable since, as opposed to a ball mill, the maximum speed of rotation and thus the grinding action is not limited by the force of gravity.

The power consumed by a such a centrifugal mill can be related to the energy expended in raising the media against the centrifugal force of the planetary rotation. Thus the power consumed by a centrifugal mill is given by:

$$P=4.785\times10^{-2}\ d\ l\ w^3\ R1^{\ 4}\ \text{watts}$$

$$(P=3.083\times10^{-9}\ d\ l\ (\text{rpm})^3\ R1^{\ 4}\ \text{horsepower})$$

where R1 is the radius of planetary motion and is in meters (feet), L is the length of the grinding tube in meters (feet), d is the mill base density in kilograms per cubic meter (lbs. per cubic foot), w is the rotation rate in radians per second, and (rpm) is the rotation rate in rounds per minute.

The grinding power of a ball mill is directly related to the power consumed in its operation. In the same way the grinding power of a planetary mill is also given by the power consumed in its operation. The grinding power of a planetary mill having a single 5.6 inch diameter grinding chamber and a length of 2.0 feet orbiting at 1000 rpm on an orbital diameter of 1.0 foot and employing 1/16 inch diameter balls is about the same as that of a conventional ball mill 4 feet in diameter and eight feet long rotating at 21 rpm and employing $\frac{3}{8}$ inch diameter balls.

What has been achieved is the power to grind large quantities of material per unit time in a small apparatus. The capital cost of the device is reduced, but the flexibility is greatly increased. For example suppose a ball mill is being used to make black ink and it is desired that yellow ink be produced instead. In the case of a ball mill a very large quantity of media must be washed free of black ink to accomplish the task. In the case of a planetary mill only a small volume need be cleaned. A practical alternative exists in the case of the planetary mill to have two grinding tubes, one for yellow and one for black. Such an alternative is, of course, not practical with a ball mill.

The basic nature of both a ball mill and the planetary mills addressed by this invention involve the rotation of a cylindrical tube with its axis perpendicular to an inertial field. In the case of a ball mill this force is furnished by the force of gravity and, as discussed above, in the case of a planetary mill this force arises from the centrifugal force caused by the planetary motion. Generally speaking the forces involved with a planetary device are many times the force associated with gravity.

In the case of a planetary mill, the force driving a particle of media, which depends upon the force field, is correspondingly greater. The rate of fall of a spherical ball in a viscous fluid in response to a force field can be calculated by means of Stokes law. This law establishes a linear relation between the rate of fall of the ball and the intensity of the force field. In the case of a planetary mill that has an effective force field sixty times as strong as gravity, we should expect that separation of the media from the material being ground occurs sixty times faster.

In the case of the helical chamber that leads material out of a mill, it can be seen that if the orientation of the rotation of the mill is in the appropriate direction, the media, provided it can reach the wall of the device during the time it takes an element of fluid to flow around a half turn, will be driven counter to the flow and back toward the grinding tube. It is also readily seen that the fact that the force field on the media is enhanced in the case of a planetary mill leads to powerful forces that tend to separate the media from the material being ground. It is this principle that permits the helical chambers in a planetary mill to act to powerfully to separate the media on a dynamic basis.

Figure 3:
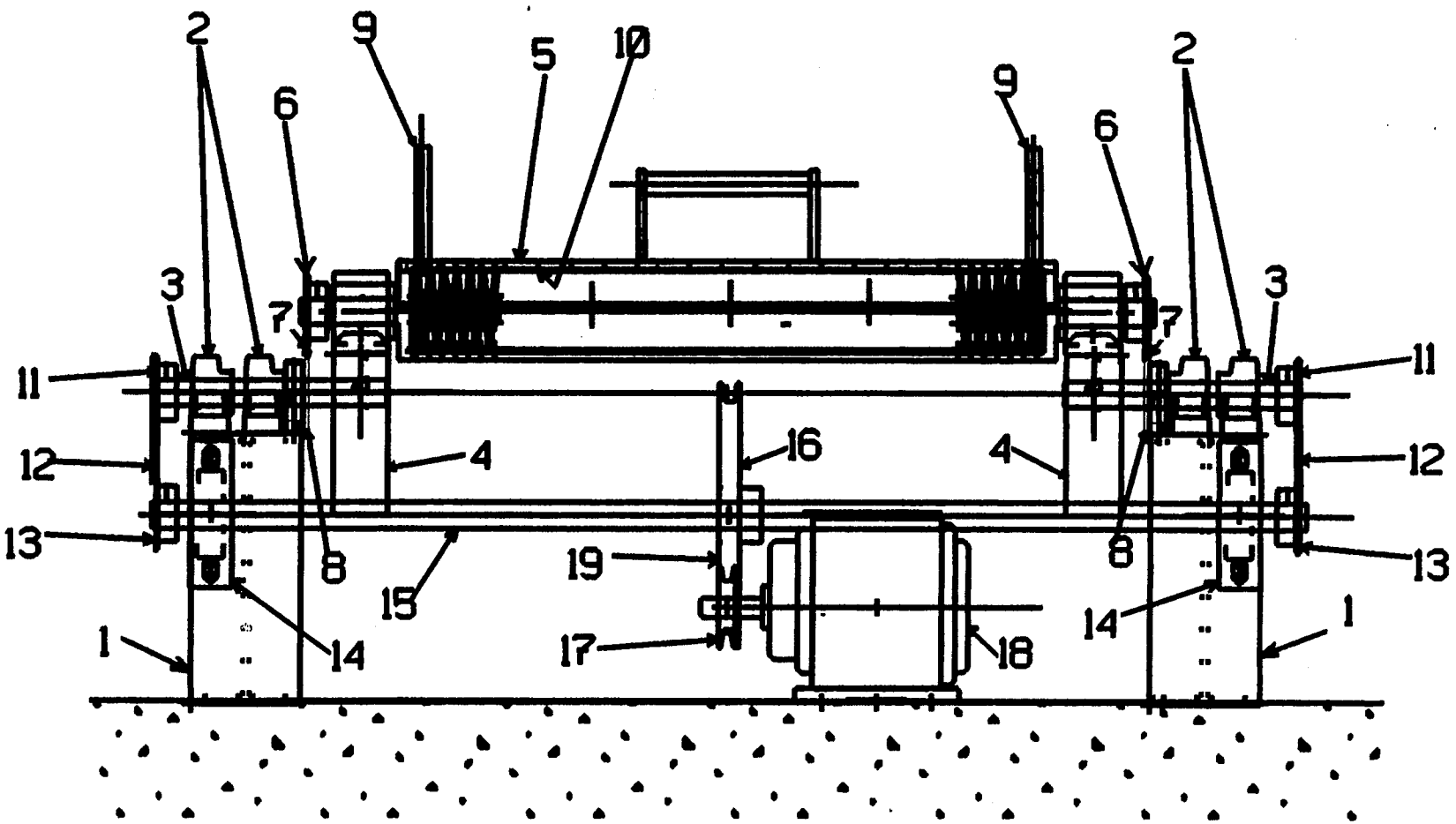
FIG. 3 is a side view of such a grinding tube incorporated in a planetary milling machine.

Reference is now made to FIG. 3 which represents a side view of one embodiment of the instant invention. End supports, 1, which are placed rigidly upon a fixed datum, support bearings, 2, that rotatably mount shafts, 3. Shafts, 3, connect rigidly to and carry rotors, 4, that, in turn, are rotatably mounted to grinding tube holder, 5. The ends of grinding tube holder, 5, project through the rotors, 4, and are rigidly connected to sprockets, 6, that in turn are interconnected by means of chains, 7, to sprockets, 8. Sprockets, 8, are rigidly connected to base, 1. By this means as the rotor rotates so as to impart planetary motion to the grinding tube carrier, the grinding carrier is constrained by sprockets 6 and 8, interconnected by means of chain, 7, to contra-rotate about its own axis at the same rate and opposite in sense to the planetary rotation of the grinding tube.

This combination of motions results in access tubes, 9, to the grinding tube, 10, which is rigidly mounted in the grinding tube holder, remaining in a vertical orientation as the grinding tube holder undergoes planetary rotation. The ends of the access tubes undergo the circular motion of the planetary rotation, but do not twist about their own axis, and as noted above, always point up. These tubes may be connected rigidly to external flexible tubes (not shown) that in turn rigidly connect to the external environment.

Shafts, 3, are driven by sprockets, 11, that in turn are driven by chains, 12, that in turn are driven by sprockets, 13. Sprockets, 13, are rigidly mounted upon jackshaft, 15, that is, in turn, driven by sheave, 16. Sheave, 16, is driven by belt, 19, that is driven by sheave, 17, that in turn is driven by motor, 18. The ratio of the size of sheave, 18, to sheave, 16, is selected to provide for an optimum rotation speed of the mill for a standard motor speed.

The helical chambers at each end of the grinding tube have the purpose of separating any media from the material being ground and returning it to the center region of the tube. Consider FIG. 1 with the grinding tube undergoing notion as shown. Now consider the helical chamber shown in FIG. 2 at the left of the grinding tube. The helix shown is a right hand screw. Such handedness is related to the human hand and means that if one places ones right hand so that the fingers wrap around the helix the thumb of the hand will point in the direction of advance of the helix if the screw is right handed. Otherwise the screw is left handed.

It is perhaps not obvious, but the property of handedness of a screw is inherent to the screw. Turning a screw through a 180 degree angle about an axis perpendicular its own axis or wrapping ones fingers from the opposite side of the screw does not affect the result achieved with the handedness test described above.

If the helical chamber at the left of the grinding tube were mounted so that it were found closest to the observer in the diagram shown in FIG. 1, since the higher density grinding media would be thrown to the outside of the grinding tube, but the tube would rotate clockwise relative to this outside position, the grinding media would be moved axially by the helical chamber. In the case shown the media would be driven axially away from the observer, that is, toward the center of the grinding tube.

Should the media have been less dense than the material being ground, the media would have been found at a position around the grinding tube about 180 degrees from that of the more dense media. However, it is readily seen that the screw action would still move the media in the same direction. The only condition that must be met is that the force perpendicular to the helical axis (that is, the inertial field) act in such a way that the element to be separated seeks a wall and thus become trapped by the helix and subject to its screw action, In the actual operation of a mill of the type shown in FIG. 3, the mill will be set in motion and a fluid be pumped in the inlet and extracted from the outlet of the grinding tube. The fluid being pumped in most likely will entrain the material to be ground in the presence of the fluid. Generally speaking the operator of the system will increase flow to the point where the grind achieved just meets measures of the specified level of fineness, It is perhaps not appropriate to discuss here the technical details of how such measurements are done. Suffice it to say there exist grind gages and so forth for various grinding tasks that permit fairly accurate control over the results achieved.

At the level of flow achieved with a particular mill, it is the objective of this invention that the helical chamber separate the media from the stream of material at the output and place it back into the center region of the grinding tube. Consider, for example the case of a helical chamber with a one inch cross section in a mill capable of grinding at the rate of ten gallons per minute. The rate of flow required gives rise to a fluid flow rate of about 100 cm per second in the helical chamber.

If we consider the viscosity of the material to be ground as one poise and consider grinding media one millimeter in diameter it will be seen that in a mill operating with a g field of a little over sixty times gravity, the rate of fall of the ball in the material being ground is about ten times faster than the transport rate of material in the helical tube, that is about 1000 cm per sec.. In such a case the media cannot be entrained in the material being ground, that is, the media will fall to the wall in the inertial field so that there is a clean separation of the material being ground from the media.

In the case of a ball mill, the rate of flow is much less and the media size larger so that conditions can readily be found wherein the mill operates so as to reject the media while permitting the material being ground to flow from the mill.

Figure 2:
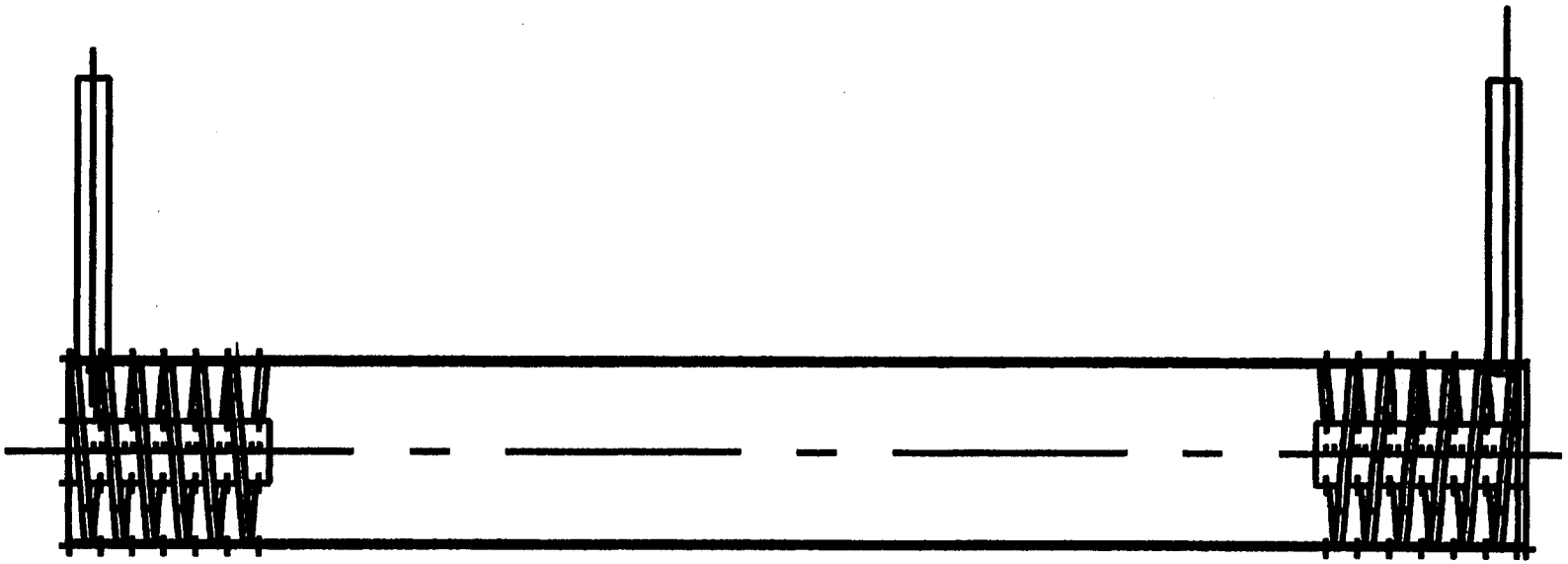
FIG. 2 is a side view of a grinding tube that has a helical chamber at either end in accord with the teachings of the invention.

In any particular case the pitch of the helix must be selected as well as any taper from one end to the other. Further the size of the central core or root of the helix must be selected as must be the shape of its cross section. The configuration shown in FIG. 2 is one particular realization. This particular configuration is readily constructed by welding a coil of flat stock, say of steel or plastic, to a central core and gluing or welding the whole inside the grinding tube as shown.

Other procedures such as wrapping tubing around a core and joining the end to an appropriately shaped hole in the grinding chamber by welding, gluing, clamping or so forth is an alternative for the realization of a helical chamber. More than one helical chamber may be run in parallel at each and by using two coils or two tubes that run in parallel. In such a case provision would need to be made for connecting each such tube to the inlet and outlet tubes.

A helix is defined mathematically by defining the motion of a point with respect to an orthogonal coordinate system. This motion is described by a point that undergoes a constant circular motion with respect to two of the coordinates while simultaneously undergoing uniform rectilinear motion along the third coordinate. A somewhat more general spiral motion involves a growing or decreasing spiral in one plane along with rectilinear motion in the direction perpendicular to this plane. The helical chambers described herein can be defined by the locus of points generated by a rigid plane, all of whose points move in a parallel spiral path.

The pitch of a spiral chamber can be described as that angle whose tangent is given by the ratio of the rate of advance divided by the rate of circular motion. Alternatively it can be defined as the angle the spiral makes with the plane defined by the circular motion.

The helical chamber in the radial direction has an inner limit or core that is called the root or core diameter. It also has an outer diameter which is conveniently selected to be the same as the inner diameter of the grinding tube though such an arrangement is not a requirement for proper operation of the system. Similarly the root diameter can be selected to range from near zero to a fraction slightly less than one of the outer diameter. I have found that such chambers that have a ratio of root diameter to outer diameter of between about 0.3 to 0.8 to be preferred.

In FIG. 2, as shown, the outer diameter of the helical chamber is the same as the inner diameter of the grinding tube and the core diameter is about one third the outer diameter. The helical chamber can have any number of turns ranging from less than one, that is a fractional number of turns, to perhaps as many as twenty, where a turn refers to the number of times the helix returns to its starting point in a projection onto the plane of its circular motion.

The desired pitch of the helical chamber used with grinding tube, as well as the number of turns involves a consideration of the conditions under which the mill operates. If the pitch angle is low, the media can more readily be carried counter to the desired stream by the flow of the material being ground. By the same token a high pitch angle requires a longer chamber to achieve a particular axial length of helix. Under this condition there may occur undesirable pressure drops. In most cases a few turns of moderately high pitch (such as, say, fifteen degrees from the vertical) and perhaps a total four to five turns appears to be desirable.

The core diameter also is not critical. If this number is small the cross sectional area of the helical chamber is large, bringing about a lower rate of flow for a given volume of material processed per unit time. On the other hand, it can readily be seen that a small root or inner core on the helix permits material to more readily be carried from turn to turn through the helix, counter to the desired direction. I have found the most preferred arrangement to be a core diameter about one half the outer diameter of the helix.

It is to be realized that the desired properties of the helical lead in and lead out chambers may be different from each other, and in any case are dependent upon the tasks faced by a particular grinding device. A machine grinding high viscosity oily materials, such as offset inks, might require relatively large helical chambers of only a turn or two at the outlet and essentially no chamber at the inlet. On the other hand the dry grinding of cement where the grinding fluid itself is air might require a number of turns of relatively high pitch and small cross section at both the outlet and inlet.

In some cases multiple grinding tubes may be used in series to accomplish a particular grinding task. As mentioned above, a ball mill may be divided into sections with connections between each section and be called a tube mill. Similarly, in some of my previous patents, discussed above, multiple grinding tubes that may be connected in series are described. In such cases, helical chambers may be used at the ends of all units treated as one, or each grinding tube may independently have input and output helical chambers. Such choices will be made by the designer of a system to accomplish a particular task and determined by the nature of the task to be accomplished.

What is claimed is:

1. A planetary grinding mill comprising a base, a rotatable drum assembly supported on said base for rotation about a horizontal axis, said drum assembly including a cylindrical grinding tube having an axis parallel to and offset from said axis of said rotatable drum assembly, said cylindrical grinding tube rotatably mounted with respect to said rotatable drum assembly, means for preventing rotation of said cylindrical grinding tube with respect to said base, driving means supported by said base and drivingly interconnected with said rotatable drum assembly, and two helical chambers of opposite screw sense connected at the ends and near the wall of said cylindrical grinding tube so as to form coaxial helical chambers as an exit and an entrance leading to external connections for entrance and for exit of material from said cylindrical tube.

2. A grinding mill according to claim 1 wherein the said helical chambers have a root diameter of at least one third of the outer diameter of the said helical chambers.

3. A grinding mill according to claim 1 wherein the said helical chambers have a pitch angle of less than fifty degrees from the direction of the said inertial force field.

4. A grinding mill according to claim 1 wherein the said helical chambers have at least one turn and less than ten turns.

5. An improved grinding apparatus comprising a base, two rotors rotatably supported on said base, for rotation about a single axis, said rotors rotatably supporting only each end of a grinding tube holder having an axis parallel to and offset from said axis of said rotors so that said grinding tube holder undergoes a planetary rotation about the said axis, a means of preventing said grinding tube holder from rotating with respect to said base, a driving means drivingly interconnected with said rotors, and at least one grinding tube mounted coaxially to and supported by said grinding tube holder, with said grinding tube holder, and two helical chambers of opposite screw sense connected at the ends and near the wall of said cylindrical grinding tubes so as to form coaxial helical chambers as an exit and an entrance leading to external connections for entrance and for exit of material from said cylindrical tube.

6. A grinding mill according to claim 5 wherein said helical chambers have a root diameter of at least one third of the outer diameter of the said helical chambers.

7. A grinding mill according to claim 5 wherein said helical chambers have a pitch angle of less than fifty degrees from the direction of said inertial force field.

8. A grinding mill according to claim 5 wherein said helical chambers have at least one turn and less than ten turns.

* * * * *